US005690253A

United States Patent [19]

LaFleur

[11] Patent Number: 5,690,253

[45] Date of Patent: Nov. 25, 1997

[54] LARGE BULK LIQUID SQUEEZE BAG

[75] Inventor: Lee LaFleur, Manistee, Mich.

[73] Assignee: Custom Packaging Systems, Inc., Manistee, Mich.

[21] Appl. No.: 705,419

[22] Filed: Aug. 29, 1996

[51] Int. Cl.[6] ..... B65D 35/28

[52] U.S. Cl. ..... 222/102; 222/107; 222/181.2

[58] Field of Search ..... 222/102, 183, 222/181.2, 105, 107; 383/117, 119, 24

[56] References Cited

U.S. PATENT DOCUMENTS

| | | | |
|---|---|---|---|
| 4,518,106 | 5/1985 | LaFleur | 222/460 |
| 4,596,040 | 6/1986 | LaFleur et al. | 383/7 |
| 4,627,551 | 12/1986 | Kopp | 222/102 |
| 4,781,472 | 11/1988 | LaFleur et al. | 383/16 |
| 4,781,473 | 11/1988 | LaFleur | 383/16 |
| 4,781,475 | 11/1988 | LaFleur | 383/119 |
| 4,790,029 | 12/1988 | LaFleur et al. | 383/24 |
| 4,817,824 | 4/1989 | LaFleur et al. | 222/105 |
| 5,104,236 | 4/1992 | LaFleur | 383/17 |
| 5,127,893 | 7/1992 | LaFleur | 493/235 |
| 5,328,268 | 7/1994 | LaFleur | 383/119 |
| 5,358,335 | 10/1994 | LaFleur | 383/107 |
| 5,421,804 | 6/1995 | LaFleur | 493/210 |
| 5,497,913 | 3/1996 | Baker | 222/102 |

*Primary Examiner*—Philippe Derakshani

*Attorney, Agent, or Firm*—Barnes, Kisselle, Raisch, Choate, Whittemore & Hulbert

[57] ABSTRACT

A flexible and collapsible bulk bag having an upright orientation in use with top and bottom end access openings to the exterior of the bag through which a flexible and collapsible liner is received in the bag, the liner also having top and bottom access openings through which the bulk contents are respectively entered and discharged. When the bag is expanded and filled it has a pair of spaced apart and generally conical ends formed by four triangular portions interconnected by four generally rectangular side walls, with the ends convergently tapering toward their associated access opening. The bag when empty can be collapsed into a compact, flat configuration having a pair of overlying front and rear panels with a pair of folded gusseted side panels received therebetween. Alternatively the liner has a rigid discharge outlet spout and a protective exterior flap spans beneath the spout outlet closure to serve as an openable, flexible protective barrier for the same. When the bag is full and ready to be discharged, the bag and liner are suspended vertically by hoisting from the bag hanger straps. A pair of squeeze nip rollers may then be applied across the front and rear panels and then pulled downwardly therealong to thereby squeeze any remaining contents out the liner discharge opening. When the discharge outlets of the liner and bag are made of flexible and compressible material, the nip roller squeegee stroke continues therealong the material of these outlets to also empty any contents remaining therein.

13 Claims, 5 Drawing Sheets

LARGE BULK LIQUID SQUEEZE BAG

FIELD OF THE INVENTION

This invention relates to a shipping and storage container and, more particularly, to a large bulk-liquid container in the form of a collapsible bag.

BACKGROUND OF THE INVENTION

Many products, such as granular and liquid materials, are shipped and stored in large bulk bags adapted to hold as much as a ton or more of material. The use of bags for this purpose has become popular because the bags can be shipped from the manufacturer to the material shipper in a generally flat condition and, if properly designed, when empty can be returned by the user to the shipper in the same generally flat condition for reuse. Commercially successful examples of such bags are disclosed and claimed in U.S. Pat. Nos. 4,518,106; 4,596,040; 4,781,472; 4,781,473; 4,781,475; 4,790,029; and 4,817,824, 5,104,236; 5,127,893; 5,328,268; 5,358,335; and 5,142,804, all assigned to Custom Packaging Systems, Inc., assignee of record herein.

Bulk bags used in the above manner and constructed in accordance with the foregoing patents fulfill several practical requirements. It is of primary importance that the construction of the bag be such as to sustain relatively heavy loads. Therefore, entire bag bodies, (top, bottom, and sides) are made from one-piece of woven polypropylene or polyethylene material to give more strength in the top and bottom due to this wrap-around full body material construction. At the same time, it is essential that the bag is adapted to be folded or collapsed to a compact flat form. The aforementioned patented bag constructions are such that the bag will return to a flat gusseted shape when empty.

Frequently, because of the nature and quantity of material shipped in such bags the bags are constructed so that they can be easily filled with, and emptied of, their contents. Angle sewing of the bag as disclosed in one or more of the aforementioned patents allows a cone top for additional room during the filling stage. This also creates excess material which can be used for nesting or stacking of bags. Moreover, like the top of the bag, angle sewing is utilized to create a cone (incline) bottom. This feature allows the material-using customer to get all of the product out of the bag quickly and completely without the need to shake the bag. Because of the aforementioned angle sewing the patented bags have a natural tendency to fold themselves during discharge. During emptying, this features causes a constant pressure to be applied to the bag contents to help knock down any bridging that may occur of the material within the bag.

In order that such bags can be readily lifted by the tines of a forklift truck, the upper ends of the bags are provided with various types of attachments, such as lifting straps and associated reinforcement bands, in combination with the unique sewing designs to create very strong bags so as to successfully withstand, for example, a 9 foot drop test while containing 2,205 pounds of product in the bag and to preferably maintain a 5 to 1 or greater safety ratio.

In addition, it is desirable, as set forth in the above identified patents, to provide the bulk bags with loose and attachable leak proof liners made of liquid and moisture impervious cheap plastic material which form-fit with the container without pleats or folds in the liner when filled so that no abnormal stress is put on the container and the containers can be filled to maximum capacity, and no valuable product is trapped in the pleats or folds of the liner.

Such liners eliminate dusting or splashing and contain odors during filling or discharging cycles in use of the bags. Such liners are constructed for insertion into any style bulk bag and are easily filled. The liners do no elongate out of the bottom of the bulk bag during discharge due to their attachment features to the exterior bag such as tape-tab and sewing techniques which holds the liner permanently in place, or a tape-tab and tied feature which allows removal of a used liner and a new liner to be inserted and tied into the bag, thereby allowing reuse of the outer bag. Such tabs can be located in accordance with the positional requirements of the customer.

The liners can be provided in a variety of single or multi-ply plastic materials to prevent problems related to corrosion, oxygen, moisture, conductivity, high temperature, and static electricity. Additionally, such liners can be provided with flexible or rigid outlet spouts to control product outflow and easy closure, and foldable and extendable inlet and outlet spouts to match the associated outer bag inlet and outlet, along with matching cone tops and bottoms. Use of such liners in the outer bulk bags saves on cleaning, storage of waste, and container replacement costs. Additionally, liners constructed in accordance with the aforementioned patent disclosures may be quickly inserted into the outer woven bag and inflated in seconds to correctly fit the bag container.

Despite the many advantageous characteristics and features of the aforementioned patented bulk bag constructions, there remains a need to provide a bag which, in addition to possessing most or all of the aforementioned desirable characteristics, will enable the economical and efficient use of such bags for containing thick, highly viscous bulk liquid products. Such materials are often difficult to empty at all from conventional bags because of the thick and sticky nature of the liquid material, and often the bags are difficult to empty completely because of the material tending to become readily trapped and/or stuck in the bag. Such viscous, liquid bulk materials are also typically of high density and hence bulk bags constructed in standard bulk bag sizes, if to be successfully employed with such high density liquid material, need to be able to suspend, transport and store say, for example, a load of 3,000 pounds, and provide volumetric capacity of 200–350gallons in a safe, economical, and reliable manner.

OBJECTS OF THE INVENTION

Accordingly, among the objects of the present invention are to provide an improved fabric bulk bag and associated interior liner which is economical to manufacture and which fulfills all of the above requirements for shipping storage, and filling and discharge of thick, highly viscous and high density liquid products, and which overcomes the aforementioned problems of inadequate filling and emptying rate, as well as incomplete emptying of the contents of the bulk bag, which has a material weight and volumetric capacity capable of meeting such requirements when constructed to standard bulk bag sizes, which can be quickly and completely emptied of all of the contents of such sticky material remaining in the bag, which provides a liquid pack bulk bag that saves substantial money over conventional barrel costs and their associated storage space, which can be quickly set up for easy filling, which is conformable to different shapes of standard encircling rigid support containers, such as square, rectangular, hexagonal, or octagonal reinforcing containers, which readily accepts product completely during the end of the filling cycle, which has very rugged lifting attachment design that also creates sidewall squeeze force for maximizing discharge of thick viscous contents, which is provided with a formed-fitting liner design that speeds product discharge and expels products that might otherwise become trapped, which has rugged inclined closure bottom support configuration that is easily opened to allow product contents to funnel the discharge spout of the liner and, which has a top spout that can be opened to assist in discharge by venting the interior of the liner, and yet which also provides all of the aforementioned advantageous characteristics of the improved bags constructed in accordance with the aforementioned patents.

A further object is to provide an improved method and bag squeezing apparatus which can be operated to squeeze out any remaining contents in the bag by progressive squeeze pressure applied externally to the bag from the top to the bottom of the bag while suspended for emptying its contents.

SUMMARY OF THE INVENTION

In general, and by way of summary description and not by way of limitation, the invention achieves the foregoing objects by providing a flexible and collapsible bulk bag having an upright orientation in use with a side wall, top and bottom ends and top and bottom end openings to the exterior of the bag through which contents are respectively entered and discharged. A flexible and collapsible liner is received in the bag generally complementary thereto and having a side wall, top and bottom ends and top and bottom openings through which the contents are respectively entered and discharged. The bag is made from a tubular blank or non-tubular sheet of reinforced flexible woven material having a circumferentially continuous central portion and four isosceles triangular portions adjacent each end constructed and arranged such that the bag when expanded has a generally cubical configuration with a pair of generally rectangular side wall panels connected by a pair of gusseted side panels. When the bag is empty it can be collapsed and folded into a generally flat configuration. The triangular portions each extend from the blank central portion toward an apex of the triangular portion and are connected adjacent their edges along lines of connection extending from at least closely adjacent the central portion toward their associated apex. The lines of connection of the triangular portions adjacent the associated end of the central portion terminate short of their apices so as to at least in part define an opening therethrough adjacent the center of the associated end defined by such triangular portions. When the bag is expanded and filled the bag thus has a pair of spaced apart and generally conical ends interconnected by four generally rectangular side walls with the ends convergently tapering toward their associated access opening. The bag end triangular portions when the bag is empty can be collapsed into a compact configuration having a pair of overlying front and rear panels with a pair of folded gusseted side panels received therebetween with the fold line between adjacent gusseted panels extending substantially to the apices of their associated opposed triangular portions and all the fold lines lying closely adjacent each other.

The bag features a pair of laterally spaced apart first and second U-shaped hanger straps formed at the top end of the bag and together flanking said bag and liner top openings. Each hanger strap comprises a first two-ply extension formed from a portion of the from panel triangular portion and a portion of the side panel triangular portion connected thereto, and extends upwardly beyond the bag top access opening from connector means joining said front and side panel triangular portions and terminates at a free end edge. The hanger strap also comprises a second two-ply extension formed from a portion of said rear panel triangular portion and a portion of the side panel triangular portion connected thereto and likewise extending upwardly beyond the bag top access opening from the connector means joining said rear and side panel triangular portions and terminates at a free end edge. These first and second two ply extensions have mutually overlapped portions permanently interconnected to thereby form a U-shaped hanger loop configuration having a four-ply thickness where these extensions mutually overlap. The apices of the straps are coaxially aligned and spaced beyond the top bag and liner access openings when the same are closed. Each of the hanger straps has a free inner edge flanking the associated side of the bag and liner access openings and is formed by a slit line in the upper end of the blank through the first and second two-ply extensions of an associated hanger strap when the blank is folded flat.

As a further feature the bag has a saddle strap reinforcement comprising first and second U-shaped end straps overlaid on the first and second hanger straps along the free inner edges thereof and extending to longitudinally opposite free ends located in the front and rear bag panels below the connector means. The saddle also has first and second cross straps extending between and joined to at their opposite ends to the U-shaped end straps and located adjacent and below said bag top access opening. The saddle is completed by first and second center straps joined at their upper ends respectively to the first and second cross straps and extending downwardly therefrom on said front and rear panels. All of these saddle straps are permanently joined to the respectively adjacent surfaces of the bag that are overlaid by the saddle straps.

As still another alternative feature, the bag is formed at the bottom end of the blank such that each line of connection of adjacent sides of adjacent triangular portions extends substantially to their apices, but stops short thereof to provide an open end at the bottom of said bag leaving at their triangular apices four flaps extending downwardly, one from each of these triangular portions. A cooperative reinforcement girdle is attached to these flaps and has a horizontal strap belt encircling the bottom end triangular portions and is affixed thereto at the junction of the lines of connections with the apex flaps. The girdle also has four belt loop straps each connected to the strap belt at one end and centered on each associated flap and extended downwardly past the lower end of the flap and then upwardly along the interior side of the flap to a connection at its other end to the flap and belt. Each belt thus forms at its lower end a loop having its apex spaced below the lower edge of the associated flap. A tie cord is strung serially through the belt loops below the lower edges of the flaps and is operable upon tightening to draw the lower ends of the belt loops together to thereby close the associated flaps across the bag bottom discharge opening. In this embodiment the bag, liner, associated fill and discharge spouts and girdle are all constructed of flexible material and are respectively compressible together by running a pair of squeeze nip rollers the entire length of said bag and spouts with the bag suspended by the pair of upper end hanger straps.

In an alternate embodiment the liner has a rigid discharge outlet spout with an annular external flange joined and sealed liquid tight to the material of the liner defining its bottom end. The spout has an outlet end protruding downwardly through the discharge opening of the bag and is closed by a removable cap plug. The bag has a protective exterior flap permanently joined at one end to one of the triangular portions at the bottom end of the bag that extends across and beneath the spout closure. A free end of the protective flap is removably attached by hook and loop material to another triangular portion of the bag such that the flap spans beneath the spout outlet closure to serve as an openable, flexible protective barrier for the same.

A method of discharging sticky, viscous material from such a flexible and collapsible bulk bag is also provided in which, as a first step, a flexible and collapsible bulk bag of the aforementioned character is provided. When the bag is full and ready to be discharged, the bag and liner are suspended vertically by hoisting the same with a hoisting implement having a pair of coaxially spaced lift arms and inserted one under each of the bag hanger strap loops. Then a pair of squeeze nip rollers are oriented and applied to the bag to span one across each of the front and rear panels of the bag exteriorly thereof beginning adjacent the upper end of said bag while so suspended. Next, squeeze pressure is applied to the bag by forcing the nip rollers toward one another into squeezing relation with the bag to thereby force the front and rear panels toward one another. While so squeezed, the nip rollers are pulled downwardly along the bag front and rear panels to thereby squeeze any contents remaining in the bag downwardly in advance of the roller pressure to force the same out the discharge opening of the liner and bag. Preferably the bag is constructed and arranged such that the discharge outlets of the liner and said bag are made of flexible and compressible material, and the squeeze rollers are drawn downwardly through a squeegee stroke which continues along the material of the discharge outlets of said bag and liner to empty any contents remaining therein out of the liner and bag by roller squeegee action.

BRIEF DESCRIPTION OF THE DRAWINGS

The foregoing, as well as other objects, features, and advantages of the present invention will become apparent from the following detailed description of preferred but exemplary embodiments of the invention and of the best mode presently known of making and using the invention, and from the appended claims and the accompany drawings, in which:

DETAILED DESCRIPTION OF THE PREFERRED EMBODIMENTS

First Embodiment Bulk Liquid Squeeze Bag

Figure 1:
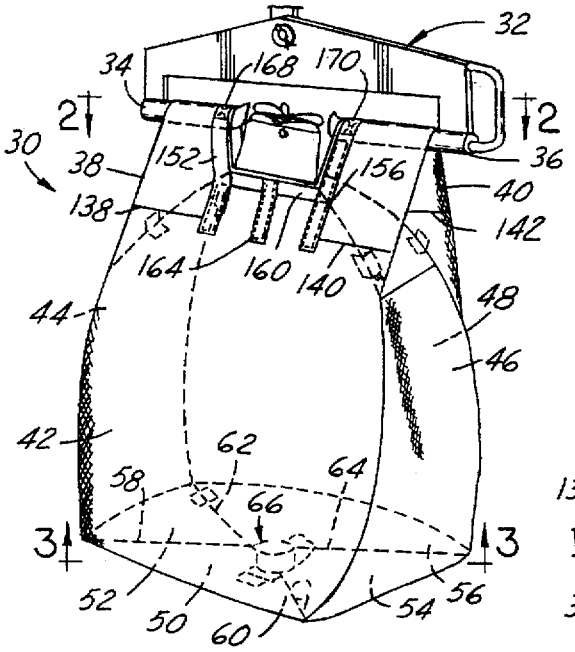
FIG. 1 is a perspective view of a first embodiment of bulk bag with liner as it appears when full and resting on a flat supporting surface while attached to a center-lift type bag lifter hoisting attachment.

Referring now in more detail to the accompanying drawings, FIG. 1 illustrates a first embodiment of a bulk-liquid material "squeeze bag" of the invention as the bag would appear fully loaded with liquid bulk material and resting on a flat support and laterally unconfined by a rigid wall enclosure, such as that shown at 300 in FIGS. 13 and 14 referred to hereinafter. Additionally, FIG. 1 illustrates a center-lift type hoisting hook 32 chain suspended from an overhead hoist, floor crane, or the like and having its lift arms 34 and 36 respectively hooked under the associated one of a pair of lift straps 38 and 40 formed by the top wall of the bag 30 in accordance with one feature of the invention, and with only light lifting tension being exerted upwardly on bag 30 by hoist attachment 32.

In FIG. 1 it will be seen that bag 30 is generally cubicle with a generally square horizontal cross section. The four vertical sidewalls of bag 30 are defined by a front panel 42, left and right (as viewed in FIG. 1), side panels 44 and 46, and rear panel 48. The bottom wall of bag 30 is formed by four triangular flaps 50, 52, 54, and 56, respectively, integrally joined at their outer edges respectively to wall panels 42, 44, 46, and 48. The flaps are joined at their inner edges to mutually adjacent edges of mutually adjacent flaps by four stitched seams 58, 60, 62, and 64, as shown by the broken hidden lines in FIG. 1, and by the solid lines in FIG. 3. A rigid-type outlet firing 66 is mounted centerly of the bottom wall at the junction of the four bottom wall flaps. A protective, flexible flap 68 is sewn at 70 to panel 50 and has a hook strip 72, made of hook-and-loop, plastic material such as that sold under the trademark Velcro, sewn to the free end of the underface of flap 68. A cooperative loop-type strip 74 is sewn to flap 56 adjacent fitting 66 to cooperate with strip 72 to form a releasable flap protective closure for fitting 66, the same being shown in releasably closed condition at FIG. 12.

Figure 4:
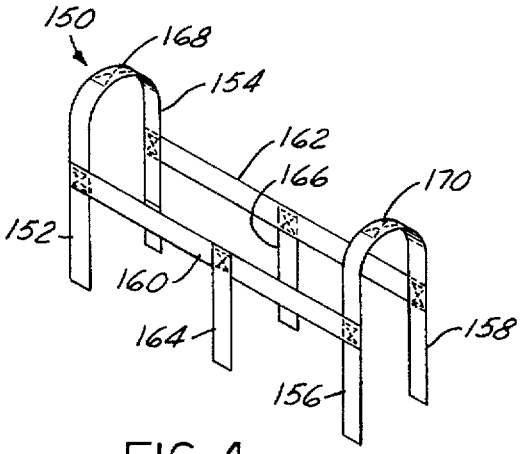
FIG. 4 is a perspective view of a strap saddle center-lift reinforcement feature of the bag, shown by itself.
Figure 5:
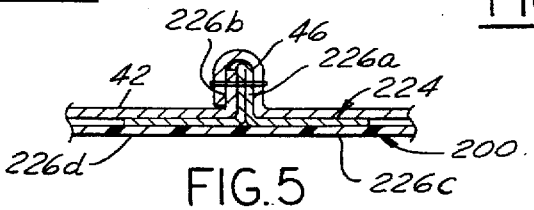
FIG. 5 is a fragmentary cross sectional view taken on the line 5—5 of FIG. 2.
Figure 6:
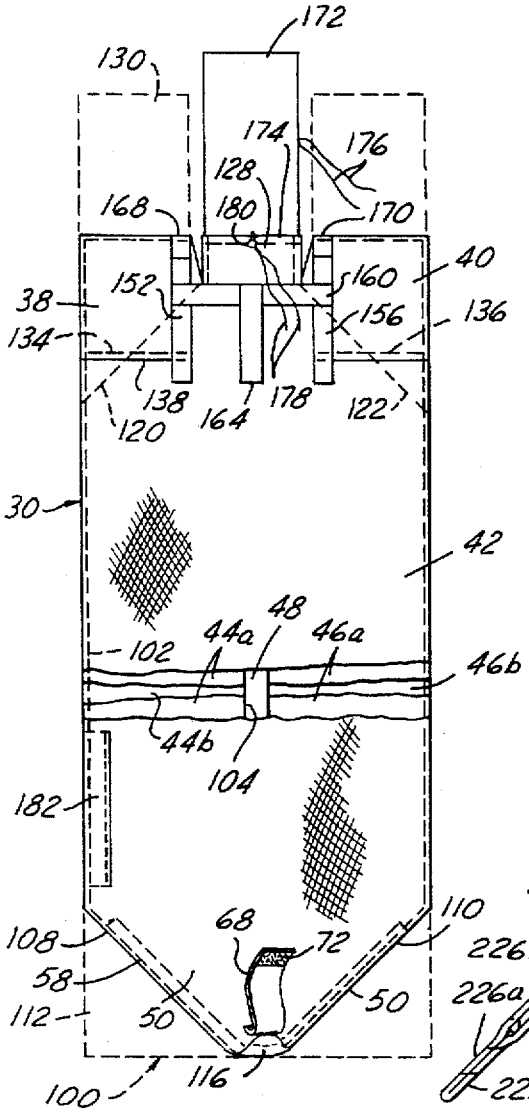
FIG. 6 is a plan view of the bag and liner of FIGS. 1–3 shown in flat side-folded condition.

Further details of bag 30, and its associated inner liner 200 will be better understood with reference to their method of construction and structural details illustrated in FIGS. 5–12. Referring first to FIG. 6, bag 30 is formed in a manner similar to the manner in which bag 14 of U.S. Pat. No. 4,596,040 is constructed, to which further reference may be made, particularly in conjunction with FIGS. 2–4 thereof, the same being incorporated herein by reference. Thus bag 30 of the present invention is likewise formed form a tubular blank 100 of a woven fabric, such as 8 ounce coated, high density polyethylene fabric. The woven fabric is formed into a tube by sewing the opposite side edges of the fabric together as at 102 (corresponding to seam 12 in FIGS. 2 and 3 of the '040 patent). The tubular blank 100 when laid flat and with its opposite side folded in, as shown in FIG. 6, comprises a pair of flat overlying panels which form the opposed front and rear sidewalls 42 and 48 of bag 30 which are connected at their respective side edges by side walls 44 and 46, as folded flat in FIG. 6. Side wall 44 forms inwardly folded gussets **44*a* and 44*b*, as seen fragmentarily in broken away section of FIG. 6, which become lefthand sidewall 44 when the bag is expanded. Likewise, inwardly folded gussets 46*a* and 46*b* become right-hand sidewall 46 when the bag is expanded. The bag illustrated is generally square in cross section and, accordingly, each folded gusset 44*a*, 44*b*, 46*a* and 46*b* has a width which is approximately half the width of the flat front and rear panels 42 and 48 of the bag. Thus the fold lines 104 and 106 of gussets 44*a*, 44*b* and 46*a*, 46*b*** extend lengthwise of the bag closely adjacent the longitudinal center line thereof.

The construction of the longitudinally opposite bottom and top ends of bag 30 differs in several respects from the bag constructed from the bag 10 in '040 patent. At the bottom end the four flaps 50–56 are formed by simultaneously cutting through the four layers of folded fabric along cut lines 108 and 110 as shown in FIG. 6 and the excess material 112 and 114 of blank 100 is discarded. Seam 58 is then stitched to join one edge of flap 50 to the adjacent edge of flap 52, and the remaining flap seams, 60, 62, and 64 are likewise formed by stitching the mutually adjacent pairs of cut edges together.

In the construction shown only in FIG. 6, a four loop zip tie belt is formed at the bottom apex of bag 30 by turning each of the end points of flaps 50–56 back upon the outside of the flaps and tacking in place to create the four belt loops, the end point belt loop 116 of flap 50 being shown in FIG. 6. One large 5/16 inch strip of zip tie material of say 32 inches in length is then threaded through the tunnel created by turning these four points of the bag bottom to the outside of the bag (the zip tie not being shown).

Figure 12:
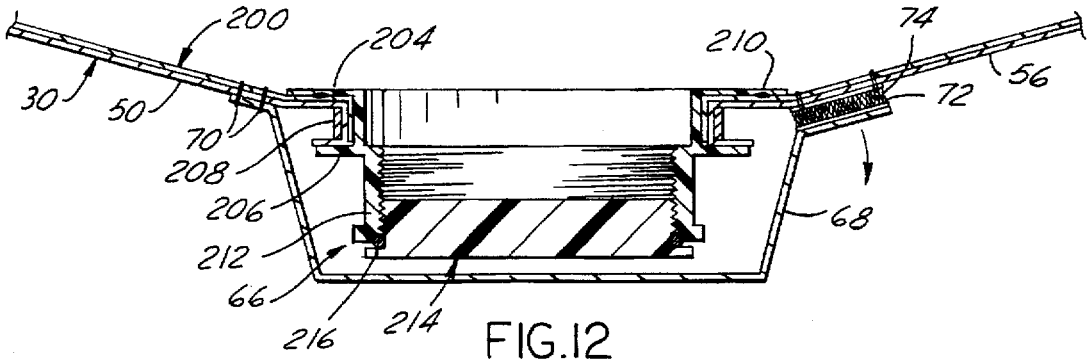
FIG. 12 is a fragmentary cross sectional view, on an enlarged scale, of the bag and liner outlet construction of the embodiment of FIGS. 1–11.

Alternatively, the bottom end points of the bag bottom flaps of the bag can be constructed as shown in FIG. 12 as described in more detail hereinafter.

Figure 2:
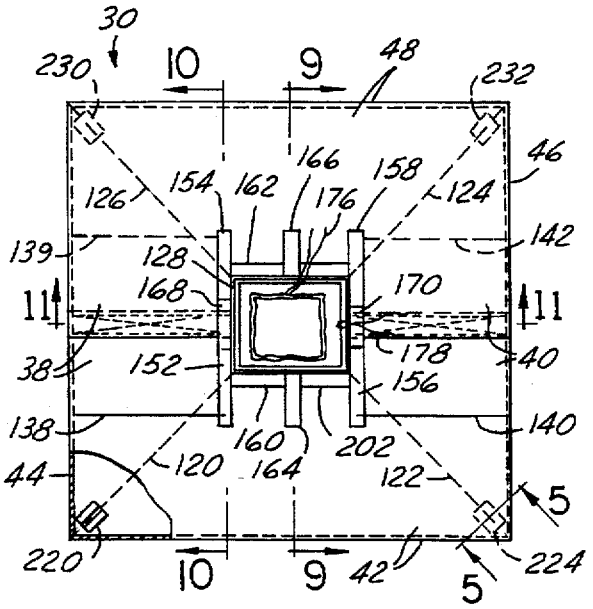
FIG. 2 is a top plan view looking in the direction of the arrows of line 2—2 of FIG. 1 but with the bag shown as it would appear when constrained by a square reinforcement container support (not shown) surrounding the exterior of the bag.
Figure 3:
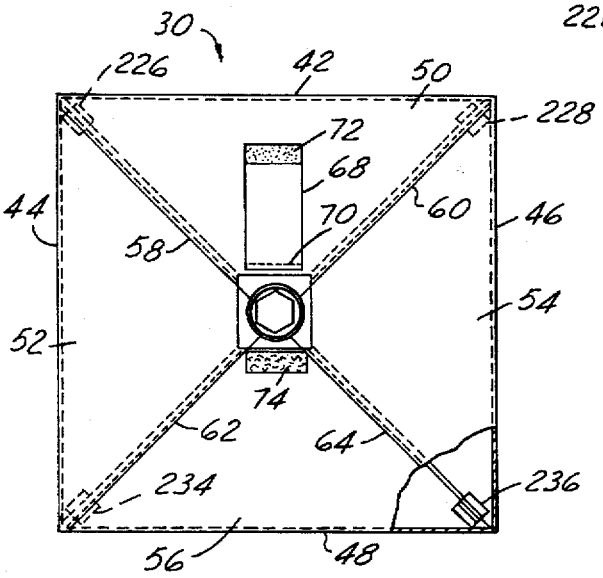
FIG. 3 is a bottom plan view looking in the direction of the arrows of line 3—3 of FIG. 1 but with the bag likewise constrained to a square configuration of the plan view of FIG. 2, and with a corner portion broken away to illustrate a detail of the interior liner attachment tab.

The construction of the upper end of bag 30 in some respects is similar to that disclosed in the aforementioned '040 patent with reference to FIGS. 2, 3, and 4 thereof, but also differs therefrom in several important respects. Referring again to FIG. 6, as well as FIG. 2, bag 30 while in the folded flat condition of FIG. 6 is formed with four diagonal lines of stitching 120, 122, 124, and 126 which converge centrally at the spout's slit lines which in turn are provided to form the rectangular bag spout 128, similar to spout 42 of the bag shown in FIG. 1 of the '040 patent. It will be seen that stitch line 120 joins from panel 42 with left-side fold **44*a*, stitch line 122 joins front panel 42 to right-side fold 46*a*, stitch line 124 joins rear panel 48 to right-side fold 46*b*, and stitch line 126 joins rear panel 48 to left-side fold 44*b***.

In accordance with one feature of bag 30, the bag suspension straps 38 and 40 are formed as extended mutual overlaps of the top wall material of the bag. The upper folded-in longitudinal extensions 130 and 132 of blank 100 shown in broken lines in FIG. 6 thus are used to quadruple the thickness of the fabric in the shoulder area of the bag. It will be understood that extensions 130 and 132 are laterally spaced apart and formed at their inner edges by the slit lines utilized in making spout 128. Hence blank extension 130 used in forming strap 38 consists of the material of front panel 42 connected at a fold at its outer edge to the underlying fold **44*a* to form a double-ply thickness superimposed over the double-ply thickness, formed by fold 44*b* connected at its outer folded edge to the back panel 48. Each of these four layers of fabric has been severed at its inner edge in making the spout slitting operation. The material of blank 100 between extensions 130 and 132 is discarded from where it has been severed from the blank in making the outer edge of spout 128. The blank extension 132 used in forming strap 40 is the mirror image of extension 130** and likewise is a four-ply layer of two folds of material with free inner edges.

As best seen in FIGS. 1, 2, 6, 10 and 11 to make the reinforced 4-ply shoulder strap 38, the uppermost double-ply layer of extension 130, consisting of the extension portions of front panel 42 and side fold **44*a*, is folded back in a half loop to bring its free edge against the lowermost double layer of extension 130. Hence the free edges of the two uppermost plys are laid against the surface of side fold 44*b* and secured thereto by a line of stitching 143 (FIG. 10) extending transversely across the four plies near the free edge 139 of this folded over half loop portion. Then the remainder of blank extension 130, consisting of the side fold 44*b* and associated extension of rear panel 48, is folded forward in a half loop so that the front surface of fold 44*b* is laid over and against the outer surface of the extension of panel 42 and joined thereto by a stitch line 134 (FIGS. 6 and 10**) extending through all four superimposed fabric layers.

To make 4-ply shoulder strap 40 the same procedure is repeated with the four layers of fabric provided in blank extension 132 of blank 100. Thus strap 40 is made up of extension portions of back panel 48 and adjacent fold **46*b* lying over and against the outer surface of panel 42, and its extension, with fold 46*a* thereunder (FIG. 11 ), thus likewise forming a four ply thickness strap. The free end edges 138 and 140 of straps 38 and 40 are both seen in FIGS. 2 and 6 and the rear inner edges 139 and 142 of straps 38 and 40 are all shown in FIG. 2. It will be seen from the foregoing that the length of blank extension 130 and 132 used in forming the 4-ply straps 38 and 40 can be readily increased or decreased from that shown in accordance with the load requirements of bag 30** to suit differing applications.

Figure 9:
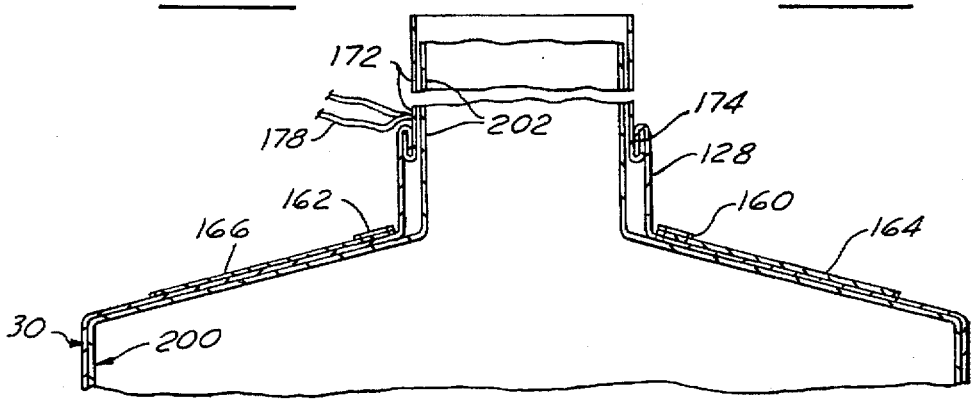
FIGS. 9, 10, and 11 are fragmentary sectional views taken respectively on the lines 9—9, 10—10, and 11—11 of FIG. 2.
Figure 10:
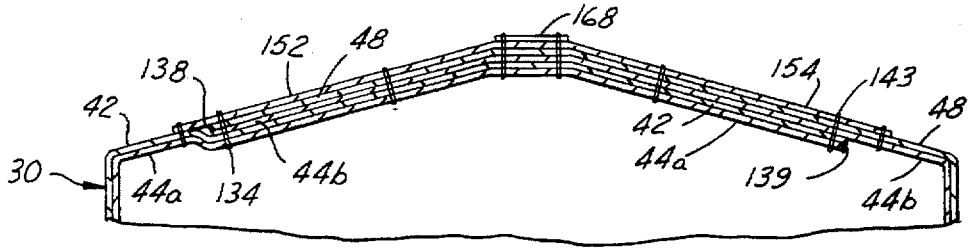
Figure 11:
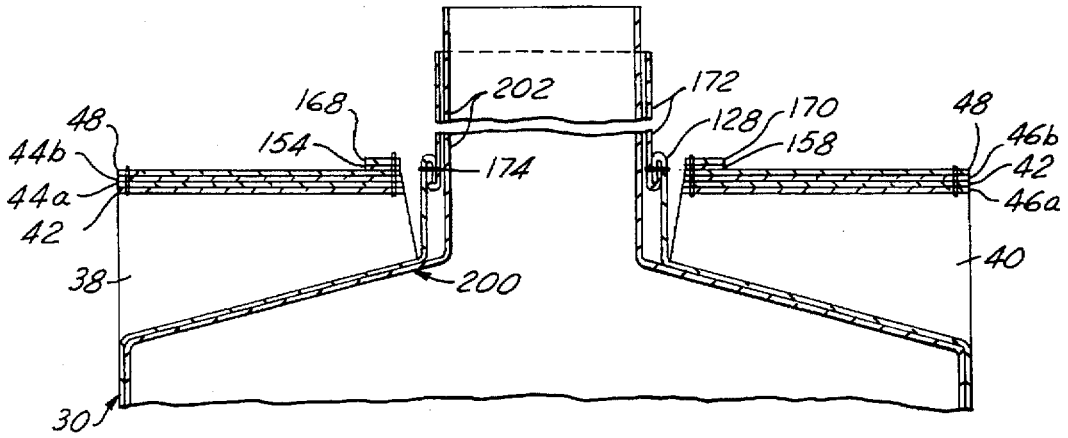

As a further feature of the invention, and to further reinforce bag 30 in the shoulder lilting area, a reinforcement saddle 150 shown by itself in FIG. 4 is stitched to the upper end of bag 30 after forming of the shoulder portions 38 and 40. Saddle 150 consists, for example, of two inch wide orange webbing pieces made up into of four 2 inch wide by 16 inch long vertical support straps 152, 154, 156, and 158 positioned on shoulders 38 and 40 of the front and back panels on either side of spout 128, as shown in FIGS. 1, 2, 6, 9, 10 and 11. A central pair of two inch by 15 inch horizontal support straps 160 and 162 are positioned on front and back panels 42 and 48 six inches below spout 128 and are stitch-connected at their ends to the associated vertical support straps 152–158, as best seen in FIG. 4. A pair of two inch by 10 inch center support straps 164 and 166 are centered longitudinally on spout 128 and their upper ends stitched respectively to horizontal supports 160 and 162. A pair of two inch by 6 inch canal covers 168 and 170 are positioned so that they are sewn over and connect the tops of the associated pairs of vertical supports 152, 154, 156, and 158, respectively. All of the support members of saddle 150 are connected by multiple lines of stitching to the underlying layers of fabric, the stitching extending through the four ply thickness of shoulders 38 and 40 (FIGS. 9, 10, and 11).

As best seen in FIGS. 2, 6, 9, and 10, the construction of bag 30 is completed by attaching a tubular fill spout 172, preferably made of five ounce weight coated, circular fabric, by telescoping its lower end into spout 128 and securing spout 172 to spout 128 by a line of stitching 174. A tie cord 176, preferably made of ½ inch by 50 inch polypropylene webbing, is attached at its center to the outer surface of spout extension 172 centrally of the tie cord and at mid length of the spout. Another tie cord 178, preferably about 30 inches in length of flat polyethylene tie cord material with acetate tips, is attached by a brass grommet 180 to the upper front edge of bag spout 128. The longitudinal stitched side seam 102 of blank 100 is reinforced by sewing on an interior reinforcement patch 182 (FIG. 6), preferably a 6 inch by 16 inch, 8 ounce fabric of the same material as blank 100, and positioned with its lower edge about two inches above the bottom corner end of seam 102 so as to overlap the inside surfaces of the sewn edge of the front and side panels 42 and 44.

First Embodiment Bag Liner

Figure 7:
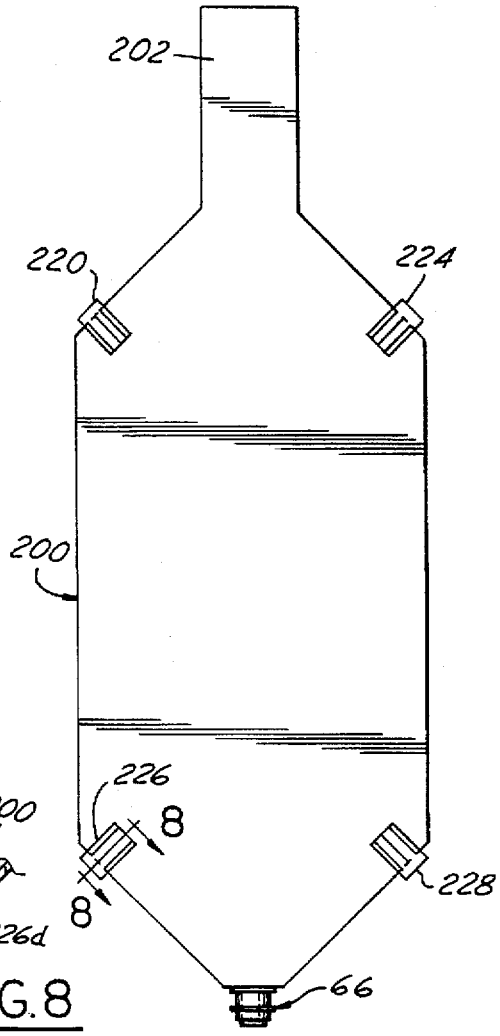
FIG. 7 is a plan view of the first embodiment liner used in the bag of FIGS. 1–6 and shown by itself in flat, side-folded condition.

Bag 30 is provided with a liquid impermeable, form-fitting interior liner, generally designated as 200 in FIG. 7, wherein liner 200 is shown by itself in folded flat condition. Liner 200 is constructed similar to liner 92 described in conjunction with FIG. 18 of the aforenoted U.S. Pat. No. 4,596,040. Preferably, liner 200 is constructed of four millimeter thickness, ultraviolet resistant, low density polyethylene of two ply thickness, to provide a high strength liquid impermeable interior lining for bag 30, and in the embodiment of FIGS. 1–16 which is preferably permanently attached to the interior of bag 30. The upper end of liner 200 is formed with a tubular spout 202 which when opened is square and concentric with bag spout 128, as best seen in FIG. 2. The liner blank preferably longer than the bag blank so that, when the liner is inserted into the bag, spout 202 of the liner will extend outwardly beyond the spout extension 172 of the bag. Bag liner 200 is formed from an initially seamless tubular blank extrusion and, after being in-folded and laid flat, is cut, as shown in FIG. 7, at its axially opposite ends to form the four end flaps at each end. These flaps are heat sealed together along their mating edges and have the inclined shape and inwardly folded side wall gusset panels corresponding to the ends of bag 30. The blank of liner 200 when folded flat as shown in FIG. 7 preferably slightly narrower in width than that of the bag blank so that the liner will fit in the bag in a flattened condition with its gusset panels interleaved with the gusset panels of the bag, but not necessarily. The liner is preferably the same size circumferentially or even an inch or so longer on each side so that no stress will be on the film and almost all stress will be contained by the stronger outer fabric bag.

The lower end of liner 200, is provided with the dispensing spout 66 as shown in detail in FIG. 12. Spout 66 preferably is a 3 ⅜ inch L.B. transport flange type C positioned at the bottom point of liner 200. Spout 66 thus has an annular external flange 204 at its upper end and another external flange 206 spaced there below. These two flanges define an external groove for receiving the free end edges of the bottom flaps of both liner 200 and bag 30 which are tucked into this groove in the manner shown in FIG. 12. If bag 30 has the folded back end flaps belt loops 116 shown in FIG. 6, the tucked-in flap free ends may be secured with the aforementioned tie cord strung through the belt loops. Alternatively, as shown in FIG. 12, the bag and liner flap free ends may be made to be tucked into the groove between flanges 204 and 206 and hermetically secured therein by an encircling retaining band 208. Band 208 may be a commercially available heavy duty plastic cable-tie. The plastic material of liner 200 is further attached and hermetically sealed to the underside of flange 204 by a annular sonic weld seam 210. The neck 212 of spout 66 is internally threaded to receive a plastic screw cap 214 removably threaded thereinto and sealed by an O-ring 216. Flap 68 when removably fastened by the hook and loops 72, 74 spans beneath spout 66 and cap 214 to provide a protective cushioned barrier for the same.

Liner 200 may be installed in bag 30 following the procedure set forth with reference FIGS. 19–21 of the aforenoted U.S. Pat. No. , 4,596,040, and if desired employing the installation tool 116 described in the '040 patent. After so installing liner 200 in bag 30 with both of them in their flattened, folded condition shown respectively in FIGS. 6 and 7, liner 200 becomes completely interleaved with the flattened bag. With the liner so arranged in the bag when the bag is filled the liner will automatically expand into cubicle shape simultaneously with expansion of the bag.

Figure 8:
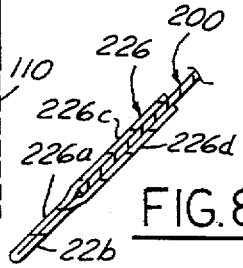
FIG. 8 is a fragmentary sectional view taken on line 8—8 of FIG. 7.

Preferably, liner 200 is secured in bag 30 by provision eight tape-tabs 220–236 (see FIGS. 1–3 as well as FIGS. 7 and 8). The upper tape-tabs 220, 224, 230, and 232 are positioned on all four top shoulders about one inch up from the corner shoulder, and the bottom tape-tabs 226, 228, 234, and 236 are likewise positioned individually on all four bottom shoulders about one inch down from the corner of the shoulder. The tape-tabs may be constructed in accordance with those disclosed and claimed in U.S. Pat. No. 4,781,472, which is incorporated herein by reference, and which is assigned to Custom Packaging Systems, Inc. of Manistee, Mich., assignee of record herein.

Alternatively, as shown herein in FIGS. 1, 2, 3, 5, 7 and 8, each tape tab 220–236 is made from fiber reinforced filament adhesive tape formed into a U-shaped loop having overlapped runs **226*a* and 226*b* and end portions 226*c* and 226*d* (FIG. 8) adhesively secured to the respective shoulder edge seam of liner 200. A reinforcing piece may be inserted and secured between runs 226*a* and 226*b*, if desired (not shown). Bag 30 when being sewn at the end panel seams 120–126 and 58–64 is left with an unstitched gap, slightly wider than tab runs 226*a*, 226*b*, at each of the eight tab locations in the bag. When liner 200 is installed in bag 30, the tab runs are pulled through the open bag seam at each associated gap therein, and then the bag seam closed with the tab stitched therein as shown in FIG. 5. Liner 200 is then thereby permanently attached to bag 30** at the eight tab locations.

Operation And Use of Bag 30 With Liner 200

Figure 13:
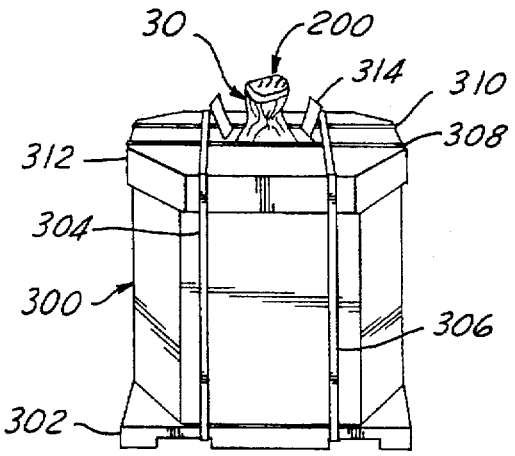
FIG. 13 is a perspective view of the bag of FIGS. 1–12 with the bag filled and installed in a hexagonal rigid open-ended reinforcing container and strapped down on a pallet ready for shipment.
Figure 14:
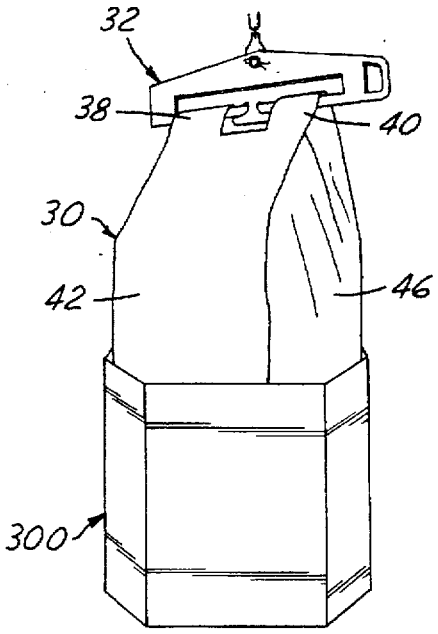
FIG. 14 is a perspective view of a single center left attachment hoisting the filled bag from the hexagonal outer restraining container of FIG. 13.

The manner of use and operation of bag 30 with liner 200 installed therein is best seen in FIGS. 1 and 13–16. For filling and storage the bag 30/liner 200 is best fitted into an open ended rigid encircling rigid retainer, such as the hexagonal retainer 300 shown in FIGS. 13 and 14. Such retainers may be made square, hexagonal, or octagonal from corrugated box material, rigid plastic board material, wire cages, metal bins, or rectangular knock-down plywood panels, as is well understood in the art. Such containers may be supported at their bottom edge on a flat pallet 302 as shown in FIG. 13, and the entire assembly secured by strapping bands 304–310 encircling the entire assembly as shown in FIG. 13. This provides a secure and easily transported and shipped filled bulk bag assembly in which the bag and its contents are well protected. Retainer 300 may also have a removable flanged top 312 if desired, with suitable opening tabs 314 to permit access to the upper spouts 128 and 202 of the bag and liner, respectively. Due to the flexible nature of bag 30 and liner 200, the same will form-fit to any such shape of container 300 either by the pressure of the contents in the bag/liner, or, when the bag is empty, by suitably inflating the bag with a forced air blower such as a shop vacuum/blower appliance. However leaf-blower type driven appliance is preferred for this purpose.

When it is desired to empty the bag of its contents, the hoist attachment 32 is attached to bag 30 by inserting its arms 34 and 36 under the bag shoulders 38 and 40 respectively when the same are in relaxed condition. Then attachment 32 is raised to put light tension on shoulder straps 38 and 40, as shown in FIG. 1. The bag may then be hoisted out of container 300 as shown in FIG. 14. When the bag has been properly positioned by hoist 32, as by being suspended over a suitable receiver for the contents of the bag, protection flap 68 may be unhooked from its protective position shown in FIG. 12 to its detached position shown in FIG. 6 to thereby properly expose the discharge end of spout 66 for use. When the spout 66 is opened by removing cap 214, gravitational forces will urge the bag contents downwardly from within the bag and out of the spout into the receiver. The content expelling action is augmented by the squeeze pressure exerted by the front and rear walls 42 and 48 of the bag because of weight of the bag contents placing these walls in tension due to the convergent inclination of the upper reaches of these front and rear walls as they merge to this center lift attachment at the apices of straps 38 and 40, this geometry tends to pull the walls together and thereby squeeze force the uppermost contents of the bag downwardly. The quadruple ply construction of straps 38 and 40 and this suspension from hoist arms 34 and 36 also assists in maintaining the upper reaches of front and rear walls 42 and 48 generally planar in form so that the opposed center-fold-creased sidewalls 44 and 46 yield and fold inwardly under the pressure of the front and back panels as the bag contents are discharged from spout 66. The construction of both bag 30 and liner 200 initially in folded form with this folded-in gusset panels also tends to cause the bag to return to its original folded, flat condition as it is emptied.

Figure 15:
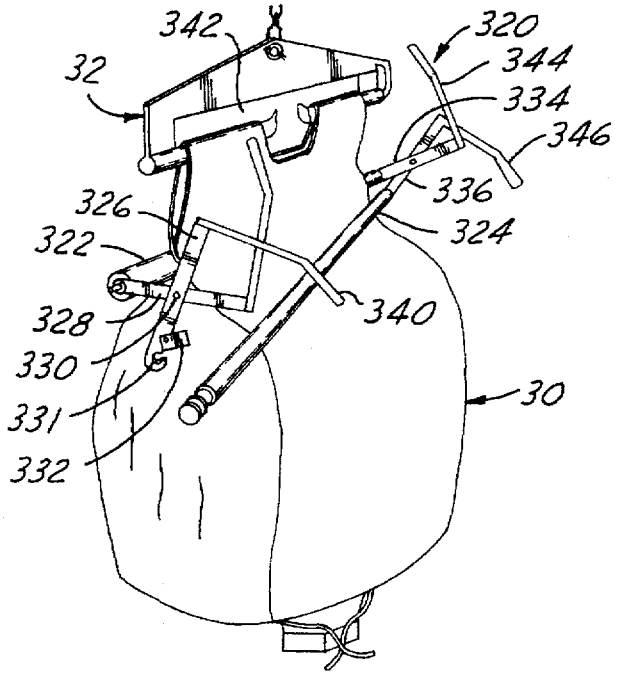
FIG. 15 is a perspective view illustrating the installation of a squeeze roller implement of the invention for practicing the method of the invention in squeezing out all and/or remaining residual contents of the bag to thereby assist gravity discharge through the bottom outlet.
Figure 16:
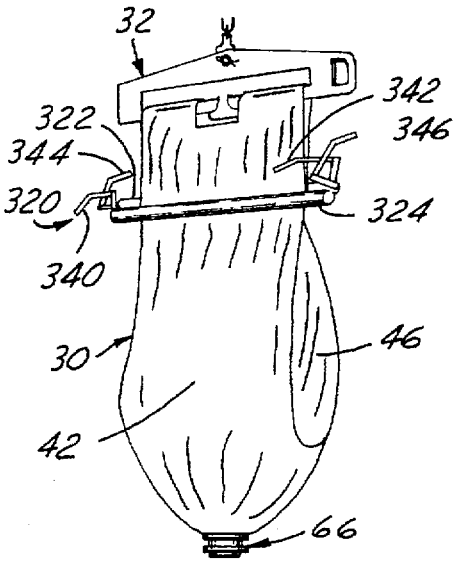
FIG. 16 is a perspective view illustrating the squeeze roller implement attached in operable position ready to be operated in a squeeze-roller downstroke along the bag.

The foregoing cooperative gravity-induced squeezing action applied by the particular construction and geometry of bag 30 and its complimentary liner 200 is effective in many applications to substantially empty the contents of the bag without external assistance or externally applied squeeze pressure. However, in accordance with the further squeeze-bag-assist feature of the present invention, and as shown in FIGS. 15 and 16, squeeze bag 30 can be additionally squeezed by use of externally applied squeeze rollers which are engaged initially at the top of the bag to nip together front and rear panels 42 and 48 near hoist 32. The squeeze rollers are then forced together while being rolled down the bag to thereby wring out the remaining contents of bag 30 by this externally applied roller ringer action. This mode of bag wring out and one suitable squeeze roller tool 320 for such use is illustrated in FIGS. 15 and 16.

Tool 320 preferably consists of a pair of rollers 322 and 324 having a lengthwise dimension greater than the width of the front and rear panels 42 and 48. Rollers 322 and 324 are held with their rotational axes parallel and laterally spaced from one another by an articulating linkage best seen in FIG. 15. This linkage includes a pair of crossed links 326 and 328 pivotally interconnected by a pivot 330 at their midpoint. The lower end of link 328 rotatably carries one end of roller 322, and the lower end of link 326 rotatably carries the adjacent end of roller 324. A hook 331 and associated latch 332 at the lower end of link 326 allow the associated end of roller 324 to be released from engagement with the link. Another pair of crossed, pivotally interconnected links 334 and 336 are provided to rotatably support the opposite ends of rollers 324 and 326. The rollers thus may be spread apart and forced together by suitably manually operating the articulating leverage of this linkage.

An operating handle 340, 342, 344 and 346 is rigidly affixed at its free end one to each of the associated links 326, 328, 334 and 336 respectively so as to protrude in a plane perpendicular to and spaced from pivot axis of the linkage. Grip handles are provided at the ends of these handles to facilitate manual operation of the linkage.

To install tool 320 for squeezing out any remaining contents from the bag, the tool is easily opened by unlatching link 326 from the associated end of roller 324. This allows tool 320 to be inserted from one side of bag 30 while suspended on the hoist, the tool being spread open to span across the upper reaches of the front and rear panels of the bag, as shown in FIG. 15. Then the loose end of roller 324 is re-hooked to link 326 and latch 332 closed. Two operating persons stationed at one at each of the opposite sides of the bag then grip the linkage handles and pull downwardly on the same. The articulation of the linkage and the mechanical advantage thereby provided forces rollers 322 and 324 into nipping relation with the front and rear panels 42 and 48 of the bag. Such pull down forces exerted on the handles continue to apply such squeeze pressure to the rollers as the tool is pulled downwardly by the operators, thereby forcing, by a roller wringer action, the front and rear panels to collapse together and develop final expulsion pressure on the residual contents of the bag. It will be seen that tool 320 can be easily opened and closed to clamp on the bag at any elevation therealong in the gravity emptying procedure.

If desired, tool 320 can be readily modified for use in an inverted relationship from that shown and described in FIGS. 15 and 16, i.e., with nip roller 324 and 326 positioned above the articulating linkage. For such use handles 340–346 are re-oriented relative to their associated links 326, 328, 334, 336 so as to extend therefrom axially opposite from that shown in FIGS. 15 and 16. With the handles so re-oriented, manual pull force exerted on each set of the handles will develop both the aforementioned nip forces to squeeze the rollers together as well as to pull the rollers down along the length of the bag. Such handle orientation reversal can facilitate bag squeezing operation when bag 30 is suspended at higher elevations relative to the operating personnel. Likewise the length of the links between their pivot points and the operating handles can be varied to change the mechanical advantage of the linkage, if desired, as well as to vary the vertical reach of the tool rollers.

Second Embodiment Squeeze Bag

FIGS. 17–20 illustrate a second embodiment of a bulk liquid squeeze bag 250 also constructed in accordance with the present invention, in which elements previously described are given the same reference numerals and their description not repeated. Bag 250 is similar to bag 30 but differs therefrom in respect to the shoulder reinforcement and lower end closure features of the bag. Also, bag 250 is adapted to removably receive a liquid-type bag liner identical to liner 200 except for the manner of interconnection of the tape-tabs 220–236 to bag 250.

Liner 200 for bag 250 may be rendered removable from the bag by providing liner 200 with tape-tabs of the type disclosed in conjunction with FIGS. 1–5 of the aforementioned U.S. Pat. No. 4,781,472. Thus the liner tabs may have grommets in the portions of the tabs protruding from their attachment to the liner for attaching a suitable tie cord or spring clip loop. However, in lieu of the four tabs 226, 228, 234 and 236 at the lower end of liner 200, liner 200 has only two tie tabs are these are attached to its front and back panels spaced a short distance above their apices (not shown).

Figure 17:
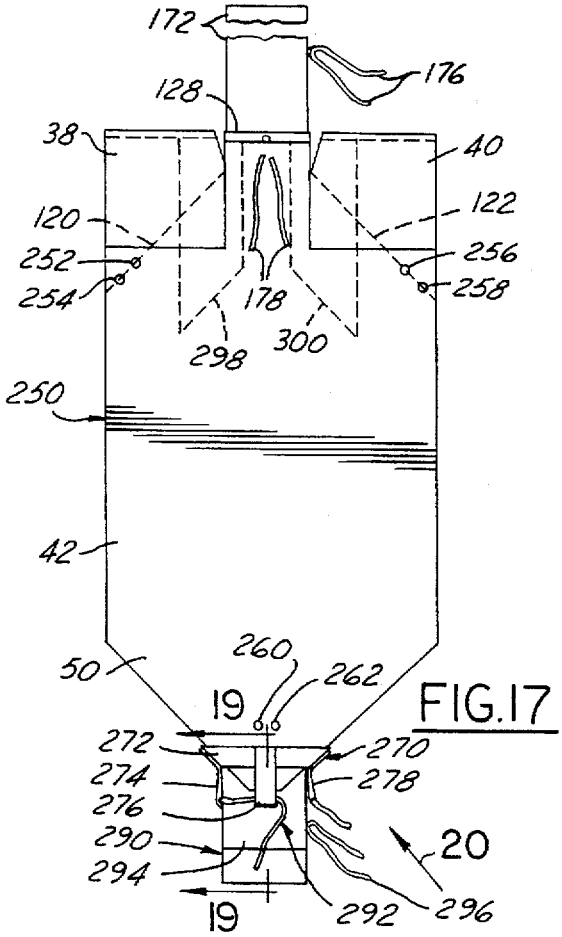
FIG. 17 is a plan view of a second embodiment of a liquid bulk material bag and liner of the invention.

In order to adapt bag 250 for use with such a modified releasable-type tab construction, bag 250 is provided with attachment holes for receiving the tie cord or clip of each of the tape tabs. As shown in FIG. 17 a pair of such bag tie holes 252 and 254 are formed in upper shoulder seams 120 and 122 spaced about one inch above the junction of these shoulders with the associated side edges of the bag. Likewise similar tie holes 256 and 258 are provided in upper shoulder seams 122 and 124 of bag 250. These holes may be formed by burning through the plastic fabric construction of bag 250 while laid flat and the sides folded inwardly. At the lower end of bag 250 another pair of tie holes 260 and 262 are provided in the lower front flap panel of the bag spaced suitably above its apex. A similar pair of burn-through holes (not shown) are located directly opposite holes 260 and 262 in the lower rear flap panel of bag 250. Four tie cords or clips are attached one to each of the four upper tie tabs of the liner and two are likewise attached to the two tie tabs at the lower end of the liner. The six cords or clips are passed through the bag holes to tie off the liner tabs to the bag to thereby removably attach the liner in the bag. It will be understood that with the liner installed in the bag, and while the bag is empty and laid flat, access can be had to the interior of the liner, the interior of the bag and between the liner and bag, their collapsible nature enabling an assembler to easily reach through the respective spouts of the bags and liner for manually attaching the liner tab ties to the bag.

Figure 18:
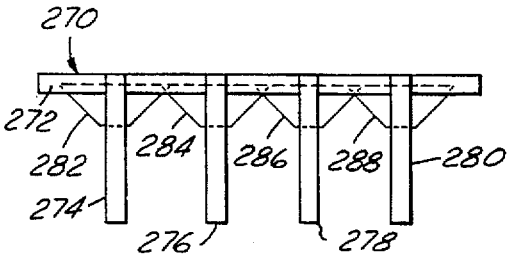
FIG. 18 is a plan view of a reinforcement belt of the bag of FIG. 17, the belt being shown by itself in layout form.
Figure 19:
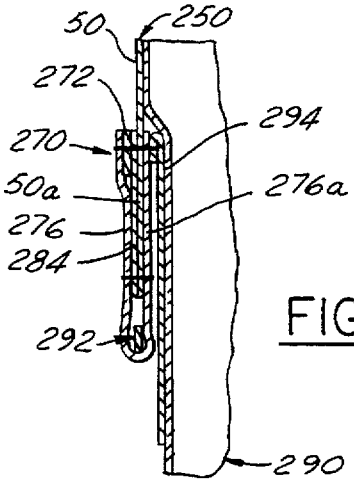
FIG. 19 is a fragmentary cross sectional view on the line 19—19 of FIG. 17.
Figure 20:
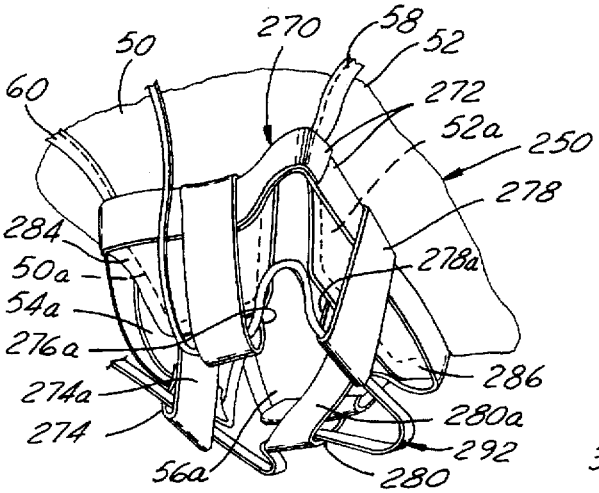
FIG. 20 is a fragmentary perspective view looking in the direction of arrow 20 of FIG. 17 and on an enlarged scale.

In accordance with the further feature of bag 250 of the invention, the lower end of the bag is heavily reinforced by a reinforcement girdle 270 shown by itself in layout form in FIG. 18, and shown attached to the lower end of bag 250 in FIGS. 17, 19 and 20. Girdle 270 comprises a suitable length, e.g., 45 inches, of two inch wide woven plastic strapping to form a belt 272 with four extension straps 274, 276, 278 and 280 overlaid at their upper ends on belt 272 and stitched thereto with their upper edges flush with the upper edges of belt 272. Straps 274–280 are spaced equally apart and extend lengthwise perpendicularly to belt 272 as shown in FIG. 18 and may for example be 16 inches in length. Four trapezoidally shaped fabric reinforcement gusset "petals" 282, 284, 286 and 288 are stitched along their base edge to the side of belt 272 opposite from that to which straps 274–280 are attached, and are individually centered on the associated strap and also stitched thereto.

In assembly with bag 250, reinforcement girdle 270 is positioned at the lower end of the bag so that belt 272 completely encircles all four of the bottom shoulder panels 50, 52, 54 and 56 of the bag at the junction therewith of four end flaps **50*a*, 52*a*, 54*a* and 56*a* which are formed as integral individual extensions of these panels. Such bottom panel flaps 50*a*–56*a* are formed by terminating the shoulder seams 58, 60, 62 and 64 short of the lower end of the bag shoulder panels so that their lower ends are left unjoined to form these flaps. Petals 282–288 individually register with associated bottom panel flap, and the lower edges of the petals and lower edges of the flaps are stitched thereto as shown in FIGS. 19 and 20. Each of the straps 274–280 is folded inwardly and back upwardly as to return loop to lay against the inner face of the associated panel flap as shown in FIG. 19. The juxtaposed layers of strap 276, petal 284, bag flap 50*a* and the return loop 276*a* are stitched together as shown in FIG. 19. This leaves approximately a 2 ½ inch free belt loop hanging from the bottom of each belt petal. A polypropylene webbing tie cord 292, of say one-half inch width and 40 inch length, is then strung through these belt loops as shown in FIGS. 17, 19 and 20. Preferably a discharge chute 290 is secured internally to the bag bottom panels at its upper end by stitching, and is made of circular coated fabric of a suitable length to hang downwardly from the bottom of the bag as shown in FIG. 17. In addition, a protective flap 294 (see FIGS. 17 and 19) may be stitched at its upper edge to the inner face of the folded back strap extension 276*a*, as shown in FIG. 19, so as to hang therefrom adjacent discharge chute 290 in the spout-opened condition of bag 250. Spout 290 is also provided with its own webbing tie cord 296 (FIG. 17) for tieing the spout closed when it is to be tucked back inside the opened panel flaps 50*a*–56*a* when closing lower end opening of bag 250. The bottom of bag 250 may then be very securely held closed by drawing tight and tieing off cord 292 thereby drawing the belt petals 282–288** together to form a secure, rugged yet flexible closure array across the bottom end of the bag.

At the upper end of bag 250, lift straps 38 and 40 may be reinforced by a pair of reinforcement panels 298 and 300 positioned as shown in FIG. 17 so as to lay against and be stitched to facing surfaces of bag side panel folds **44*a*, 44*b*, and 46*a*, 46*b* respectively. The upper ends of the U-shaped reinforcement panels 298 and 300 are slit in the bag spout 128 forming operation so that the inner ends of hook arms 34 and 36 of hoist 32 can form catches with the straps 38 and 40 in the manner of the construction of bag 30 and its attachment to hoist 32 as shown in FIG. 1**.

The modified bag 250 of the invention thus is well adapted for use as a bulk liquid content squeeze bag in the manner previously described in conjunction with bag 30 with reference to FIGS. 13–16, as well as FIG. 1. However, bag 250 is particularly well-suited for use with a removable liner containing very thick viscous materials and having its own discharge spout which can be reliably sealed with a tie cord, as further secured by using tie cord 296 to tie off bag discharge spout 290, but which materials also require flexible bag and liner discharge spouts, each having a large cross-sectional flow area, that can be squeezed flat together during the final emptying operation of the bag.

It should also be understood that the liner (not shown) employed in bag 250 is preferably modified from the construction of liner 200 so as to provide a downspout at its lower end identical to the fill spout 202 of liner 200, instead of having the rigid plastic outlet fitting 66. This liner discharge spout thus telescopes downwardly and outwardly within the bag outlet spout 290 in much the same manner as the fill spout 202 extends out within upper spout 172 of bag 30. With such discharge spout construction of both the liner and bag 250, relatively rapid discharge of even very thick gooey material contained in the bag liner can be accomplished with bag 250 suspended in the manner of bag 30 as shown in FIGS. 15 and 16. In addition, the squeeze roller tool 320 can be employed as described previously to squeeze out all of the bag contents or any contents remaining in the bag after gravity discharge thereof. Due to the flexible nature of the lower end closure construction of bag 250, these nip rollers can be run completely down the length of the bag and over the discharge spout to thereby squeeze even the last remaining contents out of the bag and hence out of the discharge spout.

In the case of very sticky materials, or materials subject to spoilage such as food materials, the bag liner would be intended only for one-time use. Hence the removable attachment of the liner as provided in the construction of bag 250 will enable the liner to be readily removed from the bag after the bag has been emptied and squeezed flat. Preferably this is accomplished with the bag hoisted and suspended on hoist 32. The upper shoulder ties are untied after the lower ones are untied, and then the bag liner is stripped from the bag by pulling the same downwardly and out of the bag discharge spout.

Multi-lift Construction Embodiment

Figure 21:
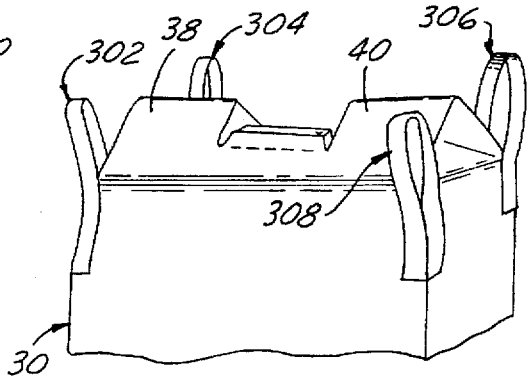
FIG. 21 is a fragmentary perspective view of lifting strap attachments affixed to the bag to provide multi-style lifting capability with either embodiment of the bag of the invention.

As shown in FIG. 21 either of the first and second embodiment bags 30 and 250 can be constructed as a multi-lift style bag by the addition of four corner hoisting straps 302, 304, 306 and 308 by following the corner strap construction disclosed and claimed in U.S. Pat. Nos. 4,781,473; 5,104,236 and/or 5,358,335, all assigned to Custom Packaging Systems, Inc., assignee of record herein, and incorporated herein by reference. Due to the flexibility of the four corner straps 302–308, the same do not impede the roller wringer squeeze action when use of squeeze roller tool 320 is desired.

I claim:

1. In combination with a flexible and collapsible bulk bag having an upright orientation in use with a side wall, top and bottom ends and top and bottom end openings to the exterior of the bag through which contents are respectively entered and discharged, a flexible and collapsible liner received in said bag generally complementary thereto and having a side wall, top and bottom ends and top and bottom openings through which the contents are respectively entered and discharged, said bag comprising a tubular blank of reinforced flexible woven material, the blank having a circumferentially continuous central portion and four isosceles triangular portions adjacent each end constructed and arranged such that said bag when expanded has a generally cubical configuration with a pair of generally rectangular side wall panels connected by a pair of gusseted side panels and such that when the bag is empty it can be collapsed and folded into a generally flat configuration, and wherein each of the triangular portions extend from the blank central portion toward an apex of the triangular portion, connector means connecting together adjacent triangular portions adjacent their edges along lines of connection extending from at least closely adjacent the central portion toward their associated apexes at least half of the distance therebetween, and the lines of connection associated with the triangular portions adjacent the associated end of the central portion terminating short of their apexes so as to at least in part define an access opening therethrough adjacent the center of the associated end defined by such triangular portions when such bag is expanded such that when filled such bag has a pair of spaced apart and generally conical ends interconnected by four generally rectangular side walls with the ends convergently tapering toward their associated access opening, and wherein said bag end triangular portions when the bag is empty can be collapsed into a compact configuration having a pair of overlying front and rear panels with a pair of folded gusseted side panels received therebetween with the fold line between adjacent gusseted panels extending between substantially the apexes of their associated opposed triangular portions and the fold lines lying closely adjacent each other;

the improvement in combination therewith comprising laterally spaced apart first and second U-shaped hanger straps formed at the top end of said bag and together flanking said bag and liner top openings, each said hanger strap comprising a first two-ply extension formed from a portion of said front panel triangular portion and a portion of the side panel triangular portion connected thereto and extending upwardly beyond the bag top access opening from said connector means joining said front and side panel triangular portions and terminating at a free end edge, and a second two-ply extension formed from a portion of said rear panel triangular portion and a portion of the side panel triangular portion connected thereto and likewise extending upwardly beyond the bag top access opening from said connector means joining said rear and side panel triangular portions and terminating at a free end edge, said first and second two ply extensions having mutually overlapped portions permanently interconnected to thereby form a U-shaped hanger loop configuration having a four-ply thickness where said extensions mutually overlap, and wherein the apices of said straps are coaxially aligned and spaced beyond said top bag and liner access openings when the same are closed.

2. The combination set forth in claim 1 wherein each ply of each of said hanger straps have a free inner edge flanking the associated side of said bag and, line access openings and being formed by a slit line in the upper end of the blank through said first and second two-ply extensions of an associated hanger strap when the blank is folded flat.

3. The combination set forth in claim 2 wherein said bag has a saddle strap reinforcement comprising first and second U-shaped end straps overlaid on said first and second hanger straps along said free inner edges thereof and extending to longitudinally opposite free ends located in the front and rear bag panels below said connector means, first and second cross straps extending between and joined to at their opposite ends to said U-shaped end straps and located adjacent and below said bag top access opening and first and second center straps joined at their upper ends respectively to said first and second cross straps and extending downwardly therefrom on said front and rear panels, all of said straps of said saddle strap reinforcement being permanently joined to the respectively adjacent surfaces of said bag overlaid by said straps.

4. The combination set forth in claim 3 which also comprises a tubular fill spout which is circumferentially continuous and a separate piece of flexible material, said spout being disposed in such top central access opening with an end portion of each triangular portion defining such central access opening overlapping said spout, and connector means connecting said tubular spout to said triangular portion at least substantially around the periphery of said spout, said fill spout being extendable between and beyond said hanger straps.

5. The combination set forth in claim 4 which also comprises said bag having a discharge spout at least in part defining said discharge opening of said bag, said liner having a discharge spout defining at least in part said discharge opening of said liner and being extendable into said discharge spout of said bag.

6. The combination set forth in claim 5 wherein at the bottom end of said blank each line of connection of adjacent sides of adjacent triangular portions extends substantially to their apices but stops short thereof to provide an open end at the bottom of said bag and leaving at the triangular apex four flaps extending downwardly, one from each of said triangular portions, and further including a reinforcement said girdle having a horizontal strap belt encircling said triangular portions and affixed thereto at the junction of said lines of connections with said apex flaps, said girdle having four belt loop straps each connected to said belt at one end and centered on each associated flap and extended downwardly past the lower end of the flap and then upwardly along the interior side of the flap to a connection at its other end to the flap and belt, each said belt thus forming at its lower end a loop having its apex spaced below the lower edge of the associated flap, and a tie cord strong serially through the belt loops below the lower edges of said flaps and operable upon tightening to draw the lower ends of the belt loops together to thereby close the associated flaps across the bag bottom discharge opening.

7. The combination set forth in claim 6 wherein said girdle also comprises a generally triangular reinforcement petal for each of said belt straps, each said petal having its base edge joined to said belt and being dependent therefrom with its apex centered on the associated belt strap to form a reinforcement gusset for said belt strap and overlying the associated closure apex flap of said bag and being permanently affixed thereto.

8. The combination set forth in claim 7 which also comprises a flap of flexible material constructed and arranged to removably overlie the bottom central opening of the bag in which said bag discharge spout is disposed and at least in part to overlie at least a portion of at least one of the triangular portions at the bottom of the bag on the interior side thereof, and connector means connecting said flexible closure flap to said one triangular portion such that said closure flap interiorly overlies the triangular portion flaps when said girdle is drawn closed by tightening said tie cord.

9. The combination set forth in claim 8 wherein said liner has a pair of generally rectangular side panels and a pair of interconnecting gusseted panels complementary to their corresponding bag panels and is constructed and arranged when expanded to have a generally cubical configuration and when empty can be folded into a generally flat configuration; a plurality of connectors between said liner and bag and each connecting said liner to said bag, said connectors being spaced apart and each located adjacent a side wall portion of said bag and adjacent the bottom end of said bag and liner having the discharge openings therethrough, and all of said connectors being connected to said liner such that said liner is not withdrawn from said bag and can collapse upon itself during discharge of the contents thereof independently of and without being substantially restricted by said bag from collapsing, whereby the contents of said bag and liner are discharged through said openings without the liner being withdrawn from said bottom bag by such discharge, and wherein said bag and liner and associated fill and discharge spouts and girdle are all constructed of flexible material and are respectively compressible together by running a pair of squeeze nip rollers the entire length of said bag and spouts with the bag suspended by said hanger straps.

10. The combination set forth in claim 9 wherein each of said connectors comprises a tab having a first portion adhered to said liner and a second portion extending therefrom through a line of connection between an adjacent pair of said triangular portions and being connected thereto in the formation of a seam defining said line of connection.

11. The combination set forth in claim 4 wherein said liner has a rigid discharge outlet spout with an annular external flange joined and sealed liquid tight to the material of said liner defining the bottom end of the liner, said spout having an outlet end protruding downwardly through the discharge opening of said bag and having a removable closure plug at the lower end of said spout, said bag having a protective exterior flap permanently joined at one end to one of the triangular portions at the bottom end of said bag and extending across and beneath said spout closure and having a free end removably attached by hook and loop means to another triangular portion of said bag such that said flap spans beneath said spout outlet closure to serve as an openable, flexible protective barrier for the same.

12. A method of discharging sticky, viscous material from a flexible and collapsible bulk bag comprising the steps of:

a) providing a flexible and collapsible bulk bag having an upright orientation in use with a side wall, top and bottom ends and top and bottom end openings to the exterior of the bag through which contents are respectively entered and discharged, a flexible and collapsible liner received in said bag generally complementary thereto and having a side wall, top and bottom ends and top and bottom openings through which the contents are respectively entered and discharged, said bag comprising a tubular blank of reinforced flexible woven material, the blank having a circumferentially continuous central portion and four isosceles triangular portions adjacent each end constructed and arranged such that said bag when expanded has a generally cubical configuration with a pair of generally rectangular side wall panels connected by a pair of gusseted side panels and such that when the bag is empty it can be collapsed and folded into a generally flat configuration, and wherein each of the triangular portions extend from the blank central portion toward an apex of the triangular portion, connector means connecting together adjacent triangular portions adjacent their edges along lines of connection extending from at least closely adjacent the central portion toward their associated apexes at least half of the distance therebetween, and the lines of connection associated with the triangular portions adjacent the associated end of the central portion terminating short of their apexes so as to at least in partly define an access opening therethrough adjacent the center of the associated end defined by such triangular portions when such bag is expanded such that when filled such bag has a pair of spaced apart and generally conical ends interconnected by four generally rectangular side walls with the ends convergently tapering toward their associated access opening, and wherein said bag end triangular portions when the bag is empty can be collapsed into a compact configuration having a pair of overlying front and rear panels with a pair of folded gusseted side panels received therebetween with the fold line between adjacent gusseted panels extending between substantially the apexes of their associated opposed triangular portions and the fold lines lying closely adjacent each other; said bag further comprising laterally spaced apart first and second U-shaped hanger straps formed at the top end of said bag and together flanking said bag and liner top openings, each said hanger strap comprising a first two-ply extension formed from a portion of said front panel triangular portion and a portion of the side panel triangular portion connected thereto and extending upwardly beyond the bag top access opening from said connector means joining said front and side panel triangular portions and terminating at a free end edge, and a second two-ply extension formed from a portion of said rear panel triangular portion and a portion of the side panel triangular portion connected thereto and likewise extending upwardly beyond the bag top access opening from said connector means joining said rear and side panel triangular portions and terminating at a free end edge, said first and second two ply extensions having mutually overlapped portions permanently interconnected to thereby form a U-shaped hanger loop configuration having a four-ply thickness where said extensions mutually overlap, and wherein the apices of said straps are coaxially aligned and spaced beyond said top bag and liner access openings when the same are closed;

b) suspending said bag and liner vertically by hoisting the same with a hoisting implement having a pair of coaxially spaced lift arms and inserted one under each of said hanger strap loops;

c) applying a pair of squeeze nip rollers oriented to span one across each of the front and rear panels of said bag exteriorly thereof beginning adjacent the upper end of said bag while so suspended;

d) applying squeeze pressure to force the nip rollers toward one another into squeezing relation with said bag to force said front and rear panels toward one another while pulling said nip rollers downwardly along said front and rear panels to thereby squeeze any contents remaining in the bag downwardly in advance of the roller pressure to force the same out the discharge opening of the liner and bag.

13. The method said forth in claim 12 wherein in step (a) said bag is constructed and arranged such that the discharge outlets of said liner and said bag are made of flexible and compressible material, wherein in step (d) said squeeze rollers are drawn downwardly through a squeegee stroke which continues along the material of the discharge outlets of said bag and liner to empty any contents remaining therein out of the liner and bag by roller squeegee action.

* * * * *